US010105867B2

(12) United States Patent
Dooley et al.

(10) Patent No.: US 10,105,867 B2
(45) **Date of Patent: *Oct. 23, 2018**

(54) COMMINUTION PROCESS TO PRODUCE ENGINEERED WOOD PARTICLES OF UNIFORM SIZE AND SHAPE FROM CROSS-GRAIN ORIENTED WOOD CHIPS

(71) Applicant: Forest Concepts, LLC, Auburn, WA (US)

(72) Inventors: James H. Dooley, Federal Way, WA (US); David N. Lanning, Federal Way, WA (US)

(73) Assignee: Forest Concepts, LLC, Auburn, WA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/444,983

(22) Filed: Feb. 28, 2017

(65) Prior Publication Data

US 2017/0297219 A1 Oct. 19, 2017

Related U.S. Application Data

(63) Continuation of application No. 13/650,400, filed on Oct. 12, 2012, now Pat. No. 9,604,387, which is a (Continued)

(51) Int. Cl.

| | |
|---|---|
| ***B27L 11/00*** | (2006.01) |
| ***D21B 1/06*** | (2006.01) |
| ***B27L 11/02*** | (2006.01) |

(52) U.S. Cl.

CPC ..... *B27L 11/00* (2013.01); *B27L 11/02* (2013.01); *D21B 1/061* (2013.01); *D21B 1/063* (2013.01)

(58) Field of Classification Search

CPC ..... B27L 11/00; B27L 11/02; B27L 11/08

See application file for complete search history.

(56) References Cited

U.S. PATENT DOCUMENTS

| | | | |
|---|---|---|---|
| 1,867 | A | 11/1840 | Winans |
| 19,971 | A | 4/1858 | Wheeler |

(Continued)

FOREIGN PATENT DOCUMENTS

| | | |
|---|---|---|
| CN | 2640259 | 9/2004 |
| DE | 1002007014293 | 10/2008 |

(Continued)

OTHER PUBLICATIONS

Erickson, J.R., Exploratory trials with spiral-head chipper to make "fingerling" chips for ring flakers, Forest Products Journal 26(6):50-53, Jun. 1976.

(Continued)

*Primary Examiner* — Matthew G Katcoff

(74) *Attorney, Agent, or Firm* — Thomas F. Broderick

(57) ABSTRACT

Comminution process of wood chips to produce wood particles, by feeding wood chips in a direction of travel substantially normal to grain through a counter rotating pair of intermeshing arrays of cutting discs arrayed axially perpendicular to the direction of wood chip travel, wherein the cutting discs have a uniform thickness (Td), to produce wood particles characterized by a length dimension (L) substantially equal to the Td and aligned substantially parallel to grain, a width dimension (W) normal to L and aligned cross grain, and a height dimension (H) aligned normal to W and L, wherein the W×H dimensions define a pair of substantially parallel end surfaces with crosscut fibers.

10 Claims, 2 Drawing Sheets

Related U.S. Application Data continuation-in-part of application No. PCT/US2011/033584, filed on Apr. 22, 2011, which is a continuation-in-part of application No. 12/966,198, filed on Dec. 13, 2010, now Pat. No. 8,039,106, which is a continuation of application No. 12/907,526, filed on Oct. 19, 2010, now Pat. No. 8,034,449.

(60) Provisional application No. 61/343,005, filed on Apr. 22, 2010.

(56) References Cited

U.S. PATENT DOCUMENTS

| | | | |
|---|---|---|---|
| 68,597 | A | 9/1867 | Borgfeldt |
| 210,927 | A | 12/1878 | Durand |
| 215,162 | A | 5/1879 | Rice |
| 257,977 | A | 5/1882 | Rice |
| 279,019 | A | 6/1883 | Rice |
| 280,952 | A | 7/1883 | Rice |
| 286,637 | A | 10/1883 | Rice |
| 295,944 | A | 4/1884 | Rice |
| 305,227 | A | 9/1884 | Rice |
| 634,895 | A | 10/1899 | Manning |
| 1,067,269 | A | 7/1913 | Palmer |
| 1,090,914 | A | 3/1914 | Guettler |
| 1,329,973 | A | 2/1920 | Jardine |
| 1,477,502 | A | 12/1923 | Killick |
| 1,485,418 | A | 3/1924 | Korbuly |
| 1,980,193 | A | 11/1934 | Finegan |
| 1,991,757 | A | 2/1935 | Lorentz |
| 2,006,107 | A | 6/1935 | Markert |
| 2,066,053 | A | 12/1936 | Podmore |
| 2,179,644 | A | 11/1939 | Rundell |
| 2,370,129 | A | 2/1945 | Asbill |
| 2,404,762 | A | 7/1946 | Zajotti |
| 2,655,189 | A | 10/1953 | Clark |
| 2,989,092 | A | 9/1954 | Clark |
| 2,773,789 | A | 12/1956 | Clark |
| 2,776,686 | A | 1/1957 | Clark |
| 3,026,878 | A | 3/1962 | Eissmann |
| 3,087,521 | A | 4/1963 | Snelson |
| 3,216,470 | A | 11/1965 | Nilsson |
| 3,219,076 | A | 11/1965 | Logan |
| 3,228,441 | A | 1/1966 | Eissmann |
| 3,229,895 | A | 6/1967 | Dearsley |
| 3,393,634 | A | 7/1968 | Blackford |
| 3,396,069 | A | 8/1968 | Logan |
| 3,415,297 | A | 12/1968 | Yock |
| 3,773,267 | A | 11/1973 | Schafer |
| 3,797,765 | A | 3/1974 | Samuels |
| 3,913,643 | A | 10/1975 | Lambert |
| 4,000,748 | A | 1/1977 | Summers |
| 4,053,004 | A | 10/1977 | Barwise |
| 4,346,745 | A | 8/1982 | Weavell |
| 4,364,423 | A | 12/1982 | Schilling |
| 4,421,149 | A | 12/1983 | Barnes |
| 4,546,806 | A | 10/1985 | Dubuc |
| 4,558,725 | A | 12/1985 | Veneziale |
| 4,610,928 | A | 9/1986 | Arasmith |
| 4,681,146 | A | 7/1987 | Liska |
| 4,953,795 | A | 9/1990 | Bielagus |
| 4,989,305 | A | 2/1991 | Pole |
| 5,029,625 | A | 7/1991 | Diemer |
| 5,048,763 | A | 9/1991 | Szardi |
| 5,087,400 | A | 2/1992 | Theuveny |
| 5,152,251 | A | 10/1992 | Aukeman |
| 5,199,476 | A | 4/1993 | Hoden |
| 5,215,135 | A | 6/1993 | Coakley |
| 5,263,651 | A | 11/1993 | Nadarajah |
| 5,505,238 | A | 4/1996 | Fujii |
| 5,533,684 | A | 7/1996 | Bielagus |
| 5,842,507 | A | 12/1998 | Fellman |
| 5,927,627 | A | 7/1999 | Edson |
| 6,267,164 | B1 | 7/2001 | Carpenter |
| 6,280,842 | B1 | 8/2001 | Nishibori |
| 6,543,497 | B2 | 4/2003 | Dietz |
| 6,575,066 | B2 | 6/2003 | Arasmith |
| 6,729,068 | B2 | 5/2004 | Dooley |
| 6,811,879 | B2 | 11/2004 | DeZutter |
| 7,291,244 | B2 | 11/2007 | DeZutter |
| 7,998,580 | B2 | 8/2011 | Brandenburg |
| 8,551,549 | B2 | 10/2013 | Leek |
| 8,757,525 | B2 | 6/2014 | Medoff |
| 2002/0061400 | A1 | 5/2002 | Rossler |
| 2006/0219826 | A1 | 10/2006 | Yamamoto |
| 2007/0045456 | A1 | 3/2007 | Medoff |
| 2009/0145563 | A1 | 6/2009 | Jarck |
| 2010/0139156 | A1 | 6/2010 | Mennell |
| 2010/0307702 | A1 | 12/2010 | Mann |
| 2012/0052298 | A1 | 3/2012 | Hagen |
| 2014/0075832 | A1 | 3/2014 | Mennell |

FOREIGN PATENT DOCUMENTS

| | | |
|---|---|---|
| EP | 1525965 | 4/2005 |
| EP | 2045057 | 4/2009 |
| GB | 394486 | 7/1933 |
| GB | 417880 | 10/1934 |
| GB | 435571 | 9/1935 |
| GB | 439381 | 12/1935 |
| GB | 462927 | 3/1937 |
| GB | 464143 | 4/1937 |
| GB | 466994 | 6/1937 |
| GB | 938951 | 10/1963 |
| JP | 2000236811 | 9/2000 |
| WO | 9717177 | 5/1997 |
| WO | 2010071954 | 7/2010 |

OTHER PUBLICATIONS

Sandlund, A.C.B., A study of wood adhesion and interactions using DMTA, Ph.D. Thesis, Lulea University of Technology, Sweden, Oct. 1984.

Janse, A.M.C., Modeling of flash pyrolysis of a single wood particle, Chemical Engineering and Processing 39:329-352, 2000.

Zeng M. et al., Microscopic examination of changes of plant cell structure in corn stover due to cellulose activity and hot water treatment, Biotechnology and Bioprocessing 98(2):265-278, 2007.

Ileleji, K.E., et al., The angle of repose of bulk corn stover particles, Powder Technology 187(2):110-118, 2008.

Buckmaster, D.R., Assessing activity access of forage or biomass, Transactions of the ASABE 51(6):1879-1884, 2008.

Lanning, D., et al., Mode of failure for cutting solid section biomass, ASABE Paper No. 085111, Jun. 2008.

Kaliyan, N., et al., Commercial scale grinding of corn stover and perennial grasses, ASABE Paper No. 1009062, Jun. 2010.

Hongzhang, C., et al., The inhomogeneity of corn stover and its effects on bioconversion, Biomass and Bioenergy 35, pp. 1940-1945, 2011.

International Search Report and Written Opinion, dated Aug. 30, 2011, in International application No. PCT/US2011/033584.

Li, Z., et al., Cell morphology and chemical characteristics of corn stover fractions, Industrial Crops and Products 37, pp. 130-136, Jan. 2012.

Gil, M., et al., Handling behavior of two milled biomass: SRF poplar and corn stover, Fuel Processing Technology 112, pp. 76-85, 2013.

Liu, Z-H., et al., Effects of biomass particle size on steam explosion pretreatment performance for improving the enzyme digestibility of corn stover, Industrial Crops and Products 44, pp. 176-184, 2013.

COMMINUTION PROCESS TO PRODUCE ENGINEERED WOOD PARTICLES OF UNIFORM SIZE AND SHAPE FROM CROSS-GRAIN ORIENTED WOOD CHIPS

STATEMENT OF GOVERNMENT LICENSE RIGHTS

This invention was made with government support by the Small Business Innovation Research program of the U.S. Department of Energy, Contract SC0002291. The government has certain rights in the invention.

FIELD OF THE INVENTION

Our invention provides a rotary bypass shear comminution process to produce precision wood feedstock particles from veneer and wood chips.

BACKGROUND OF THE INVENTION

Wood particles, flakes, and chips have long been optimized as feedstocks for various industrial uses (see, e.g., U.S. Pat. Nos. 2,776,686, 4,610,928, 6,267,164, and 6,543,497), as have machines for producing such feedstocks.

Optimum feedstock physical properties vary depending on the product being produced and/or the manufacturing process being fed. In the case of cellulosic ethanol production, the feedstock should be comminuted to a cross section dimension of less than 6 mm for steam or hot water pretreatment, and to less than 3 mm for enzymatic pretreatment. Uniformity of particle size is known to increase the product yield and reduce the time of pretreatment. Uniformity of particle size also affects the performance of subsequent fermentation steps.

Piece length is also important for conveying, auguring, and blending. Over-length pieces may tangle or jam the machinery, or bridge together and interrupt gravity flow. Fine dust-like particles tend to fully dissolve in pretreatment processes, and the dissolved material is lost during the washing step at the end of preprocessing.

Particle shape can be optimized to enhance surface area, minimize diffusion distance, and promote the rate of chemical or enzyme catalyst penetration through the biomass material. Such general goals have been difficult to achieve using traditional comminution machinery like shredders, hammer mills, and grinders.

Gasification processes that convert biomass to syngas present a different set of constraints and tradeoffs with respect to optimization of particle shape, size, and uniformity. For such thermochemical conversions, spherical shapes are generally favored for homogeneous materials, and enhancement of surface area is less important. Cellulosic plant derived feedstocks are not homogeneous, and thus optimal properties involve complex tradeoffs.

A common concern in producing all bioenergy feedstocks is to minimize fossil fuel consumption during comminution of plant biomass to produce the feedstock.

SUMMARY OF THE INVENTION

Herein we describe a comminution process to produce a new class of wood feedstock particles characterized by consistent piece size and shape uniformity, high skeletal surface area to volume ratio, and good flow properties. Such precision feedstock particles are conveniently manufactured from wood veneer materials at relatively low cost using the disclosed low-energy comminution processes.

The invention provides a process of comminution of wood veneer having a grain direction and a substantially uniform thickness (Tv) to produce wood particles characterized by a disrupted grain structure, a substantially uniform length dimension (L) aligned substantially parallel to the grain direction, a width dimension (W) normal to L and aligned substantially cross grain, and a height dimension (H) normal to W and L and substantially equal to the Tv. The wood veneer is fed in a direction of travel substantially normal to the grain direction through a counter rotating pair of intermeshing arrays of cutting discs arrayed axially perpendicular to the direction of veneer travel wherein the cutting discs have a uniform thickness (Td) that is substantially equal to the desired particle length (L). This comminution process produces uniform wood particles of roughly parallelepiped shape, characterized by L×H dimensions that define a pair of substantially parallel side surfaces with substantially intact longitudinally arrayed fibers, L×W dimensions that define a pair of substantially parallel top and bottom surfaces, and W×H dimensions that define a pair of substantially parallel end surfaces with crosscut fibers and a disrupted grain structure characterized by end checking between fibers.

The veneer is preferably aligned within 30° parallel to the grain direction, and most preferably the direction of veneer travel is within 10° parallel to the grain direction.

To further enhance grain disruption, the veneer and cutting discs may be selected such that Td÷Tv=4 or less, and preferably 2 or less, in which case the comminution process tends to promote pronounced surface checking between longitudinally arrayed fibers on the top and bottom surfaces of the particles.

For production of feedstocks for bioenergy processes, a Td is typically selected in the range between 1/32 inch and 3/4 inch. For use in many conversion processes the veneer Tv and the cutting disc Td are paired such that at least 80% of the produced wood particles pass through a 1/4 inch screen having a 6.3 mm nominal sieve opening but are retained by a No. 10 screen having a 2 mm nominal sieve opening. For particular end uses, the veneer Tv and cutting disc Td may be co-selected to produce precision feedstocks such that at least 90% of the particles pass through either: an 1/4 inch screen having a 6.3 mm nominal sieve opening but are retained by a 1/8-inch screen having a 3.18 mm nominal sieve opening; a No. 4 screen having a 4.75 mm nominal sieve opening screen but are retained by a No. 8 screen having a 3.18 mm nominal sieve opening; a 1/8-inch screen having a 3.18 mm nominal sieve opening but are retained by a No. 16 screen having a 1.18 mm nominal sieve opening; a No. 10 screen having a 2.0 mm nominal sieve opening but are retained by a No. 35 screen having a 0.5 mm nominal sieve opening; a No. 10 screen having a 2.0 mm nominal sieve opening but are retained by a No. 20 screen having a 0.85 mm nominal sieve opening; or, a No. 20 screen having a 0.85 mm nominal sieve opening but are retained by a No. 35 screen having a 0.5 mm nominal sieve opening.

The wood veneer may be comminuted in a green, seasoned, or rehydrated condition, but to minimize feedstock recalcitrance in downstream fractionation processes the veneer should be comminuted at a field moisture content greater than about 30% wwb.

BRIEF DESCRIPTION OF THE DRAWINGS

wood feedstock particles produced from veneer by the disclosed comminution process.

DETAILED DESCRIPTION OF THE PREFERRED EMBODIMENT

Figure 1:
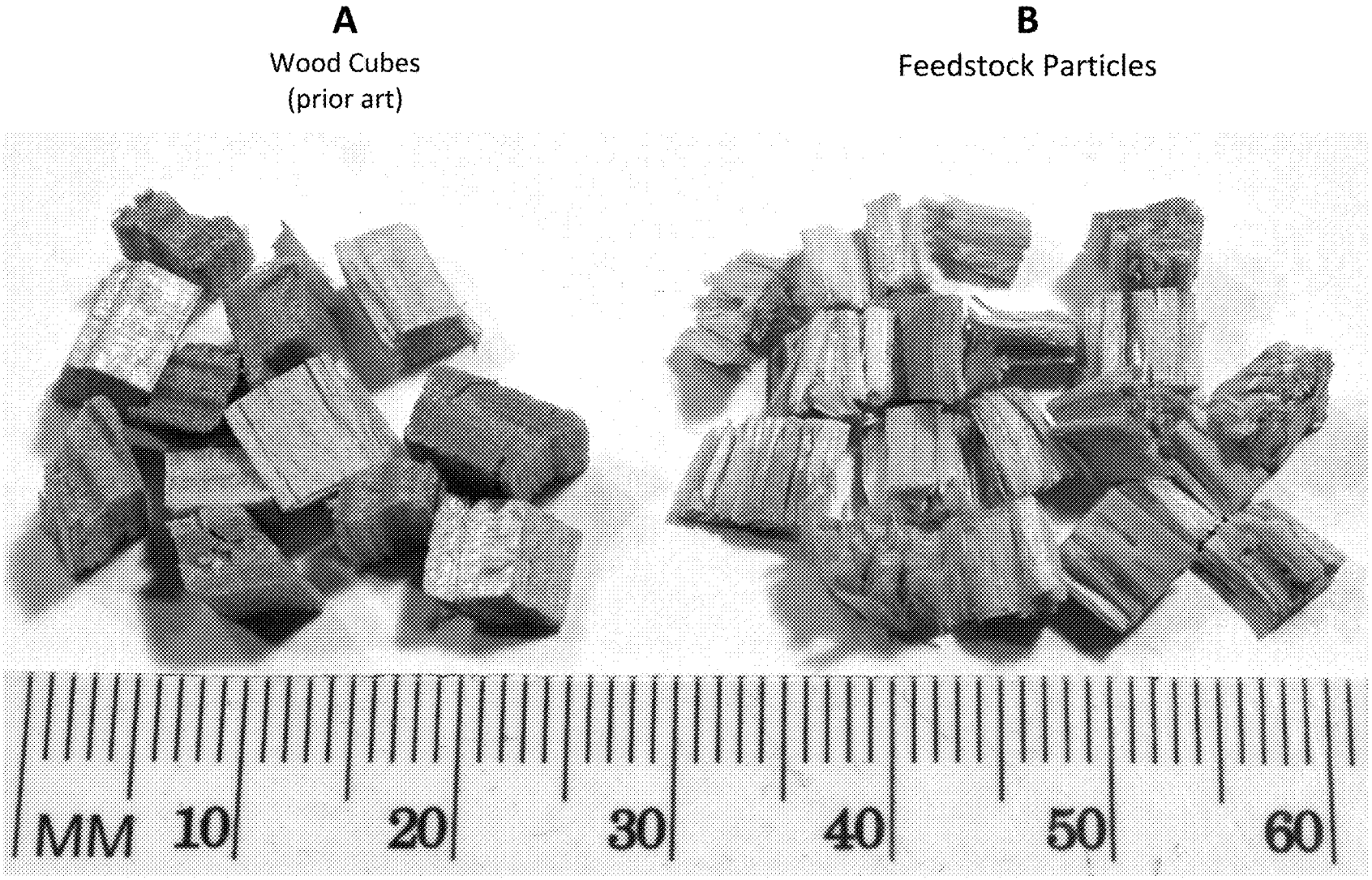
FIG. 1 is a photograph of similarly sized (A) prior art wood cubes typical of coarse sawdust or chips, and (B)

We have applied engineering design principles to develop a low-energy comminution process that produces a new class of wood particles from veneer. The comminution process produces prominent end checks and some surface checks that disrupt the grain structure and greatly enhance the particles' skeletal surface area as compare to envelope surface area. Representative wood feedstock particles of the invention are shown in FIG. 1B, which indicates how the nominal parallelepiped shape or extent volume of the particles is cracked open by pronounced checking that greatly increases surface area.

The term "veneer" as used herein refers generally to wood peeled, sawn, or sliced into sheets of a given constant thickness (Tv).

The term "grain" as used herein refers generally to the arrangement and longitudinally arrayed direction of plant fibers within a wood veneer material. "Grain direction" is the orientation of the long axis of the dominant fibers in a sheet of wood veneer.

The terms "checks" or "checking" as used herein refer to lengthwise separation and opening between fibers in a wood particle. "Surface checking" may occur on the lengthwise surfaces a particle (that is, on the L×W surfaces); and "end checking" occurs on the cross-grain ends (W×H) of a particle.

The term "skeletal surface area" as used herein refers to the total surface area of a wood particle, including the surface area within open pores formed by checking between plant fibers. In contrast, "envelope surface area" refers to the surface area of a virtual envelope encompassing the outer dimensions the particle, which for discussion purposes can be roughly approximated to encompass the particle's extent volume dimensions.

The term "field moisture content" refers to veneer that retains a harvested moisture content above the approximately 30% fiber saturation point below which the physical and mechanical properties of wood begin to change as a function of moisture content. Such a veneer has not been dried below its fiber saturation point and then rehydrated, e.g., by soaking in water.

The adjectives "green" and "seasoned" indicate veneers having moisture contents of more than or less than 19%, respectively.

The term "disc" refers to a circular object having a uniform thickness (Td) between two opposing flat sides of equal diameter. Td is conveniently measured with an outside caliper.

The feedstock particles produced by our rotary bypass shear comminution process can be readily optimized for various bioenergy conversion processes that produce ethanol, other biofuels, and bioproducts. The particles advantageously exhibit: a substantially uniform length (L) along the grain direction that is determined by the uniform thickness (Td) of the cutter discs; a width (W) tangential to the growth rings (in wood) and normal to the grain direction; and a height (H), oriented radial to the growth rings and normal to the W and L dimensions, that is substantially equal to the thickness (Tv) of the veneer raw material.

We have found it very convenient to use wood veneer from a centerless rotary lathe process as a raw material. Peeled veneer from a rotary lathe naturally has a thickness that is oriented with the growth rings and can be controlled by lathe adjustments. Moreover, within the typical range of veneer thicknesses, the veneer contains very few growth rings, all of which are parallel to or at very shallow angle to the top and bottom surfaces of the sheet. In our process, we specify the veneer thickness (Tv) to match the desired wood particle height (H) to the specifications for a particular conversion process.

The veneer may be processed into particles directly from a veneer lathe, or from stacks of veneer sheets produced by a veneer lathe. Our preferred manufacturing method is to feed veneer sheet or sliced materials into a rotary bypass shear with the grain direction oriented across and preferably at a right angle to the feed direction through the machine's processing head, that is, parallel to the shearing faces.

Figure 2:
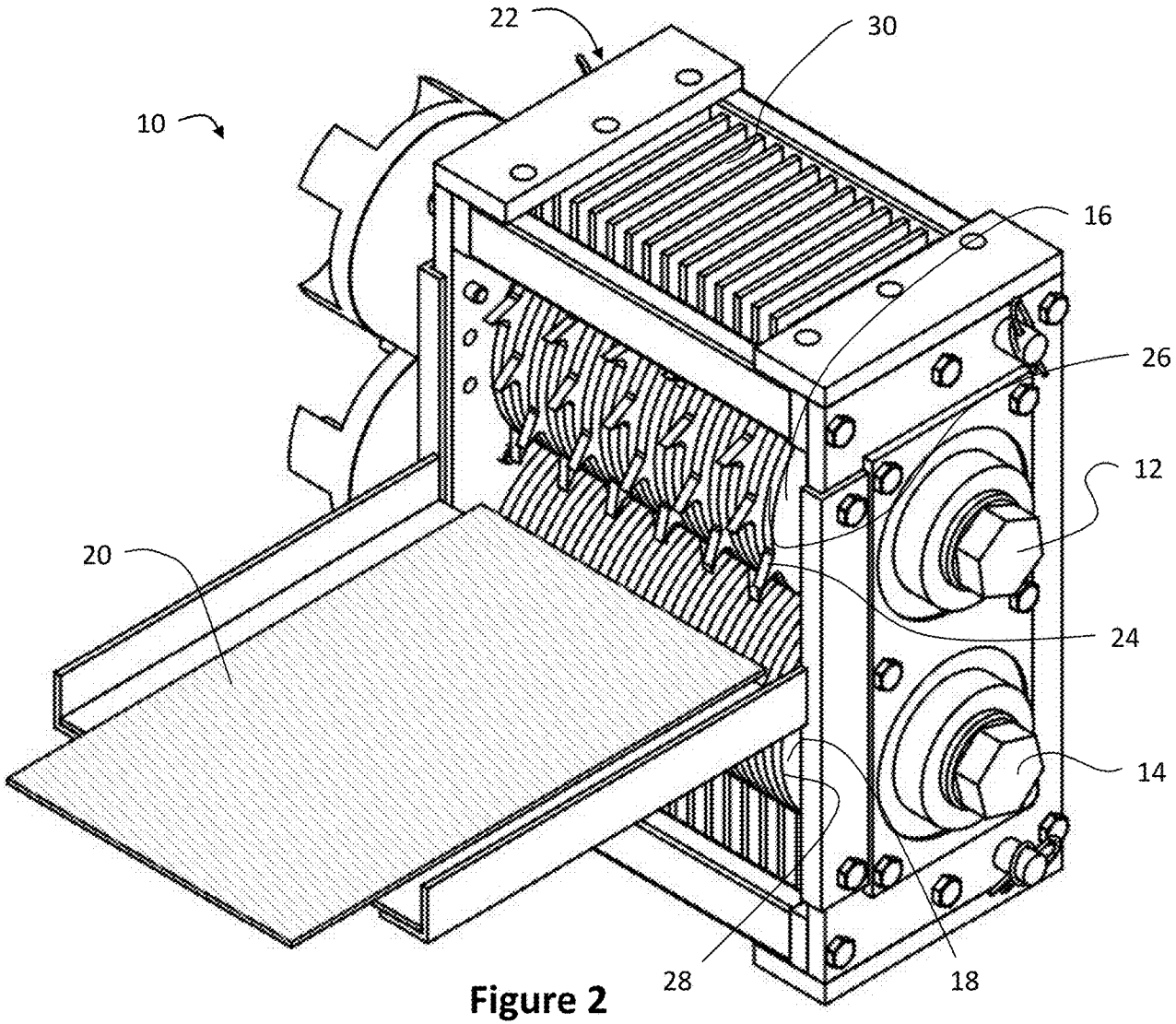
FIG. 2 is a perspective view of a prototype rotary bypass shear machine suitable for comminuting wood veneer into precision particles.

The rotary bypass shear that we designed for manufacture of precision wood feedstock particles is a shown in FIG. 2. This prototype machine 10 is much like a paper shredder and includes parallel shafts 12, 14, each of which contains a plurality of cutting disks 16, 18. The disks 16, 18 on each shaft 12, 14 are separated by smaller diameter spacers (not shown) that are the same width or greater by 0.1 mm thick than the Td of the cutting disks 16, 18. The cutting disks 16, 18 may be smooth 18, knurled (not shown), and/or toothed 16 to improve the feeding of veneer sheets 20 through the processing head 22. Each upper cutting disk 16 contains five equally spaced teeth 24 that extend 6 mm above the cutting surface 26. The spacing of the two parallel shafts 12, 14 is slightly less than the diameter of the cutting disks 16, 18 to create an intermeshing shearing interface. In our machine 10, the cutting disks 16, 18 are approximately 105 mm diameter and the shearing overlap is approximately 3 mm.

This rotary bypass shear machine 10 used for demonstration of the manufacturing process operates at an infeed speed of one meter per second (200 feet per minute). The feed rate has been demonstrated to produce similar particles at infeed speeds up to 2.5 meters per second (500 feet per minute).

The width, or thickness (Td), of the cutting disks 16, 18 establishes the length (L) of the particles produced since the veneer 20 is sheared at each edge 28 of the cutters 16, 18 and the veneer 20 is oriented with the fiber grain direction parallel to the cutter shafts 12, 14 and shearing faces of the cutter disks 16, 18. Thus, wood particles from our process are of much more uniform length than are particles from shredders, hammer mills and grinders which have a broad range of random lengths. The desired and predetermined length of particles is set into the rotary bypass shear machine 10 by either installing cutters 16, 18 having uniform widths (Td) equal to the desired output particle grainwise length (L) or by stacking assorted thinner cutting disks 16, 18 to the appropriate cumulative cutter width (Td).

It should be understood that, alternatively, an admixture of for example nominal 2×2 mm and 2×4 mm particles can be produced directly from 2 mm veneer by stacking the shafts 12, 14 of machine 10 with a desired ratio of alternating pairs of 2 mm- and 4 mm-wide cutting discs 16, 18.

Fixed clearing plates 30 ride on the rotating spacer disks to ensure that any particles that are trapped between the cutting disks 16, 18 are dislodged and ejected from the processing head 20.

We have found that the wood particles leaving the rotary bypass shear machine 10 are broken (or "crumbled") into short widths (W) due to induced internal tensile stress failures. Thus the resulting particles are of generally uniform length (L) along the wood grain, as determined by the selected width (Td) of the cutters 16, 18, and of a uniform thickness (H, as determined by the veneer thickness, Tv), but vary somewhat in width (W) principally associated with the microstructure and natural growth properties of the raw material species. Most importantly, frictional and Poisson forces that develop as the veneer material 20 is sheared across the grain at the cutter edges 28 tend to create end checking that greatly increases the skeletal surface areas of the particles. Substantial surface checking between longitudinally arrayed fibers further elaborates the L×W surfaces when the length to height ratio (L/H) is 4:1 and particularly 2:1 or less.

The output of the rotary bypass shear 10 may be used as is for some conversion processes such as densified briquette and pellet manufacture, gasification, or thermochemical conversion. However, many end-uses will benefit if the particles are screened into more narrow size fractions that are optimal for particular end-use conversion processes. In that case, an appropriate stack of vibratory screens or a tubular trommel screen with progressive openings can be used to remove particles larger or smaller than desired. In the event that the feedstock particles are to be stored for an extended period or are to be fed into a conversion process that requires very dry feedstock, the particles may be dried prior to storage, packing or delivery to an end user.

We have used this prototype machine 10 to make feedstock particles in various lengths from a variety of plant biomass materials, including: peeled softwood and hardwood veneers; sawed softwood and hardwood veneers; softwood and hardwood branches and limbs crushed to a predetermined uniform height or maximum diameter; cross-grain oriented wood chips and hog fuel; corn stover; switchgrass; and bamboo. The L×W surfaces of peeled veneer particles generally retain the tight-side and loose-side characteristics of the raw material. Crushed wood and fibrous biomass mats are also suitable starting materials, provided that all such biomass materials are aligned across the cutters 16, 18, that is, with the shearing faces substantially parallel to the grain direction, and preferably within 10° and at least within 30° parallel to the grain direction.

We currently consider the following size ranges as particularly useful biomass feedstocks: H should not exceed a maximum from 1 to 16 mm, in which case W is between 1 mm and 1.5×the maximum H, and L is between 0.5 and 20×the maximum H; or, preferably, L is between 4 and 70 mm, and each of W and L is equal to or less than L.

For flowability and high surface area to volume ratios, the cutter disc thickness Td and veneer thickness T dimensions are co-selected so that at least 80% of the particles pass through a ¼ inch screen having a 6.3 mm nominal sieve opening but are retained by a No. 10 screen having a 2 mm nominal sieve opening. For uniformity as reaction substrates, at least 90% of the particles should preferably pass through: a ¼" screen having a 6.3 mm nominal sieve opening but are retained by a No. 4 screen having a 4.75 mm nominal sieve opening; or a No. 4 screen having a 4.75 mm nominal sieve opening but are retained by a No. 8 screen having a 2.36 mm nominal sieve opening; or a No. 8 screen having a 2.36 mm nominal sieve opening but are retained by a No. 10 screen having a 2 mm nominal sieve opening. Most preferably, the subject biomass feedstock particles are characterized by size such that at least 90% of the particles pass through: a ¼ inch screen having a 6.3 mm nominal sieve opening but are retained by a ⅛-inch screen having a 3.18 mm nominal sieve opening; or a No. 4 screen having a 4.75 mm nominal sieve opening screen but are retained by a No. 8 screen having a 2.36 mm nominal sieve opening; or a ⅛-inch screen having a 3.18 mm nominal sieve opening but are retained by a No. 16 screen having a 1.18 mm nominal sieve opening; or a No. 10 screen having a 2.0 mm nominal sieve opening but are retained by a No. 35 screen having a 0.5 mm nominal sieve opening; or a No. 10 screen having a 2.0 mm nominal sieve opening but are retained by a No. 20 screen having a 0.85 mm nominal sieve opening; or a No. 20 screen having a 0.85 mm nominal sieve opening but are retained by a No. 35 screen having a 0.5 mm nominal sieve opening.

Suitable testing screens and screening assemblies for empirically characterizing the produced wood particles in such size ranges are available from the well-known Gilson Company, Inc., Lewis Center. Ohio, US (www.globalgilson-.com). In a representative protocol, approximately 400 g of the subject particles (specifically, the output of machine 10 with ⅜"-wide cutters and ⅙" conifer veneer) were poured into stacked ½", ⅜", ¼", No. 4, No. 8, No. 10, and Pan screens; and the stacked screen assembly was roto-tapped for 5 minutes on a Gilson® Sieve Screen Model No. SS-12R. The particles retained on each screen were then weighed. Table 1 summarizes the resulting data.

TABLE 1

| | Screen size | | | | | | |
|---|---|---|---|---|---|---|---|
| | ½" | ⅜" | 3¼" | No. 4 | No. 8 | No. 10 | Pan |
| % retained | 0 | 0.3 | 1.9 | 46.2 | 40.7 | 3.5 | 7.4 |

These data show a much narrower size distribution profile than is typically produced by traditional high-energy comminution machinery.

Thus, the invention provides precision wood particles characterized by consistent piece size as well as shape uniformity, obtainable by cross-grain shearing a veneer material of selected thickness by a selected distance in the grain direction. Our rotary bypass shear process greatly increases the skeletal surface areas of the particles as well, by inducing frictional and Poisson forces that tend to create end checking as the biomass material is sheared across the grain. The resulting cross-grain sheared plant biomass particles are useful as feedstocks for various bioenergy conversion processes, particularly when produced in the size classifications described above.

EXAMPLES

Wood particles of the present invention were manufactured as described in above described machine 10 using 3/16" wide cutters from a knot-free sheet of Douglas fir ⅙" thick veneer (10-15% moisture content). The resulting feedstock was size screened, and from the Pass ¼", No Pass No. 4 fraction for the precision desired in this particular experiment a 10 g experimental sample was collected of particles that in all dimensions passed through a ¼" screen (nominal sieve opening 6.3 mm) but were retained by a No. 4 screen (nominal sieve opening 4.75 mm). Representative particles from this experimental sample (FS-1) are shown in FIG. 1B.

Similarly sized cubes indicative of the prior art were cut from the same veneer sheet, using a Vaughn® Mini Bear Saw™ Model BS 150D handsaw. The sheet was cut cross-grain into approximately 3/16" strips. Then each strip was gently flexed by finger pressure to break off roughly cubeshaped particles of random widths. The resulting feedstock was size screened, and a 10 g control sample was collected of particles that in all dimensions passed through the ¼" screen but were retained by the No. 4 screen. Representative cubes from this control sample (Cubes-1) are shown in FIG. 1A.

The outer (or extent) length, width, and height dimensions of each particle in each sample were individually measured with a digital outside caliper and documented in table form. Table 2 summarizes the resulting data.

TABLE 2

| Samples (10 g) | Number of pieces | Length (L) | Width (W) | Height (H) |
|---|---|---|---|---|
| Control cubes (Cubes-1) | n = 189 | Mean 5.5 SD 0.48 | Mean 5.0 SD 1.17 | Mean 3.9 SD 0.55 |
| Experimental particles (FS-1) | n = 292 | Mean 5.3 SD 0.74 | Mean 5.8 SD 1.23 | Mean 3.3 SD 0.82 |

The Table 2 data indicates that the extent volumes (extent L×extent W×extent H) of these rather precisely size-screened samples were not substantially different. Accordingly, the cubes and particles had roughly similar envelope surface areas. Yet the 10 gram experimental sample contained 54% (292/189) more pieces than the 10 gram control sample, which equates to a mean density of 0.34 g/particle (10/292) as compared to 0.053 g/cube. FIG. 1 indicates that the roughly parallelepiped extent volumes of typical particles (1B) contain noticeably more checks and air spaces than typical cubes (1A). These differences demonstrate that the feedstock particles produced from veneer by rotary bypass shear comminution had significantly greater skeletal surface areas than the control cubes indicative of prior art coarse sawdust and chips.

While the preferred embodiment of the invention has been illustrated and described, it will be appreciated that various changes can be made therein without departing from the spirit and scope of the invention.

We claim:

1. A process of comminution of wood chips to produce wood particles, wherein the wood chips are characterized by a grain direction and a substantially uniform thickness (Tv), wherein the comminution process comprises the step of feeding the wood chips in a direction of travel substantially normal to the grain direction through a counter rotating pair of intermeshing arrays of cutting discs arrayed axially perpendicular to the direction of wood chip travel, wherein the cutting discs have a uniform thickness (Td), and wherein the wood particles are characterized by a length dimension (L) substantially equal to the Td and aligned substantially parallel to the grain direction, a width dimension (W) normal to L and aligned cross grain, and a height dimension (H) substantially equal to the Tv and aligned normal to W and L, wherein the L×H dimensions define a pair of substantially parallel side surfaces with substantially intact longitudinally arrayed fibers, the W×H dimensions define a pair of substantially parallel end surfaces with crosscut fibers, and the L×W dimensions define a pair of substantially parallel top and bottom surfaces.

2. The comminution process of claim 1, wherein the direction of wood chip travel is aligned within about 30° parallel to the grain direction.

3. The comminution process of claim 2, wherein the direction of wood chip travel is aligned within about 10° parallel to the grain direction.

4. The comminution process of claim 1, wherein Td÷Tv=4 or less.

5. The comminution process of claim 4, wherein Td÷Tv=2 or less.

6. The comminution process of claim 1, wherein the Td is between 1/32 inch and ¾ inch.

7. The comminution process of claim 6, wherein the Td and the Tv are such that at least 80% of the produced wood particles pass through a ¼ inch screen having a 6.3 mm nominal sieve opening but are retained by a No. 10 screen having a 2 mm nominal sieve opening.

8. The comminution process of claim 1, wherein the Td and the Tv are such that at least 90% of the produced particles pass through either: an ¼ inch screen having a 6.3 mm nominal sieve opening but are retained by a ⅛-inch screen having a 3.18 mm nominal sieve opening; a No. 4 screen having a 4.75 mm nominal sieve opening screen but are retained by a No. 8 screen having a 3.18 mm nominal sieve opening; a ⅛-inch screen having a 3.18 mm nominal sieve opening but are retained by a No. 16 screen having a 1.18 mm nominal sieve opening; a No. 10 screen having a 2.0 mm nominal sieve opening but are retained by a No. 35 screen having a 0.5 mm nominal sieve opening; a No. 10 screen having a 2.0 mm nominal sieve opening but are retained by a No. 20 screen having a 0.85 mm nominal sieve opening; or, a No. 20 screen having a 0.85 mm nominal sieve opening but are retained by a No. 35 screen having a 0.5 mm nominal sieve opening.

9. The comminution process of claim 1, wherein the wood chips are comminuted in a green, seasoned, or rehydrated condition.

10. The comminution process of claim 1, wherein the wood chips are-comminuted at a retained field moisture content greater than about 30% wwb.

* * * * *